US005864952A

United States Patent [19]

Chung

[11] Patent Number: 5,864,952

[45] Date of Patent: Feb. 2, 1999

[54] KNIFE FOR WOODWORKING

[75] Inventor: Yen-chao Chung, Taipei, Taiwan

[73] Assignee: Lutz File & Tool Company, Cincinnati, Ohio

[21] Appl. No.: 778,306

[22] Filed: Jan. 2, 1997

[51] Int. Cl.[6] ..... B26B 1/08; B26B 5/00

[52] U.S. Cl. ..... 30/162; 30/331; 30/332

[58] Field of Search ..... 30/162, 330, 331, 30/332, 337, 2, 335

[56] References Cited

U.S. PATENT DOCUMENTS

| | | | |
|---|---|---|---|
| 1,768,604 | 7/1930 | Hurd | 30/332 X |
| 2,548,797 | 4/1951 | Ingwer et al. | 30/162 |
| 3,509,627 | 5/1970 | Gilbert et al. | 30/332 X |
| 3,660,895 | 5/1972 | West | 30/332 X |
| 3,857,176 | 12/1974 | Quenot | 30/162 |
| 4,005,525 | 2/1977 | Gringer | 30/162 X |
| 4,068,375 | 1/1978 | Rathbun et al. | 30/162 X |
| 4,240,202 | 12/1980 | Gilbert | 30/162 |
| 4,524,518 | 6/1985 | West | 30/330 |
| 4,868,985 | 9/1989 | Rehm | 30/162 |
| 4,936,014 | 6/1990 | Shaanan et al. | 30/162 |
| 5,022,156 | 6/1991 | Kallens et al. | 30/125 |
| 5,031,322 | 7/1991 | Jacoff | 30/162 |
| 5,121,544 | 6/1992 | Gilbert | 30/162 |
| 5,301,428 | 4/1994 | Wilcox | 30/162 |
| 5,386,632 | 2/1995 | Schmidt | 30/125 |
| 5,581,890 | 12/1996 | Schmidt | 30/162 |

FOREIGN PATENT DOCUMENTS 0 196 437 8/1989 European Pat. Off. .

*Primary Examiner*—Eugenia A. Jones
*Attorney, Agent, or Firm*—Killworth, Gottman, Hagan & Schaeff, L.L.P.

[57] ABSTRACT

A knife for woodworking, which is convenient for a user to dispose a blade thereinto, is disclosed. The knife includes a first casing and a second casing. The two casings are pivotedly joined at one end thereof . The first casing has an insert mounted therein. The insert defines a slot thereon. The second casing has a fitting member extending from an inner face thereof and through the slot of the insert. By urging the insert, the fitting member will be interlocked with the periphery of the slot so that the first casing is engaged with the second casing. By releasing the insert, the first casing and the second casing will open to facilitate a disposition of the blade, without separating the pivoted joint thereof.

4 Claims, 10 Drawing Sheets

KNIFE FOR WOODWORKING

FIELD OF THE INVENTION

The present invention relates to a knife for woodworking, and more particularly to a knife used for woodworking, which is convenient for a user to dispose a blade thereinto.

DESCRIPTION OF RELATED ART

A conventional knife for woodworking has a structure as shown in FIG. 12 and FIG. 13. The knife comprises a first casing 80, a second casing 81 engaged with the first casing 80, and a double-ended blade 82 disposed between the first casing 80 and the second casing 81 at a front end thereof. Referring to FIG. 13, the inner faces of first and second casings 80, 81, respectively, define opposed channels 83 to receive the blade 82. A tool rest 84 is disposed between the two opposed channels 83 to secure one end of the blade 82. The knife further has a push button 85 extending through a same side face of the first and the second casing 80, 81 to control the movement of the blade 82. To engage the first casing 80 with the second casing 81, a pair of opposed holes 86 are respectively defined in each surface of the casings 80, 81, thereby, a screw 87 can extend therethrough, as shown in FIG. 12.

When the double-ended blade 82 is worn out, it can be reversed to use or to be replaced. In this case, a problem involved with the conventional knife occurs. That is, the disposition of the blade 82 requires that the first casing 80 and the second casing 81 be separated. Meanwhile the disassembly and reassembly of the knife must be accomplished by a tool , for example, a screwdriver. This problem not only makes the operation of the knife complex, but also increases the inconvenience when a user is working at an elevated position above ground level.

The present invention provides an improved knife for woodworking to mitigate and/or obviate the aforementioned problems.

SUMMARY OF THE INVENTION

One object of the present invention is to provide a knife for woodworking which is convenient for a user to dispose a blade thereinto.

In accordance with one aspect of the present invention, a knife for woodworking comprises a first casing, a second casing and a blade disposed between the first and second casings. The first casing defines a depression extending inwardly from an outer surface at an appropriate position thereof, and has an insert mounted within the depression. The insert defines thereon a wide slot and a narrow slot communicating with the wide slot. The second casing is joined with the first casing at one end thereof and has a boss integrally extending from an inner face thereof. The boss defines a circumferential recess at an appropriate portion thereon to correspond to the wide slot and the narrow slot of the insert.

In accordance with another aspect of the present invention, the knife for woodworking comprises a first casing, a second casing pivotedly connected with the first casing, and a blade disposed between the first casing and the second casing. The first casing defines a depression extending inwardly from an outer surface at an appropriate position thereof, and has an insert mounted within the depression. The insert defines thereon a wide slot and a narrow slot communicating with the wide slot. The second casing has a fitting member extending from an outside surface to an inside surface of the casing at an appropriate position thereof. The fitting member comprises a retainer and a post extending from the retainer. The post defines a first circumferential recess adjacent to a top portion thereon to correspond to the wide slot and the narrow slot of the insert of the first casing, and has a resilient means mounted therearound and compressed between the retainer and an outer face of the second casing.

In accordance with a further aspect of the present invention, the first casing further defines a front end and a rear end. Each end has a pair of opposed protrusions respectively extending from two sides thereof . The pair of protrusions from the rear end define a pair of aligned holes therein. The second casing defines a narrow front end and a narrow rear end and two opposed side walls. The narrow front end and the narrow rear end of the second casing are exactly and respectively disposed between the two pairs of opposed protrusions of the first casing. The side wall at the narrow rear end of the second casing defines thereon a pair of apertures corresponding to the holes of the first casing so that a pin extends through the holes and the apertures to pivotedly engage the first casing with the second casing.

Other objects, advantages and novel features of the invention will become more apparent from the following detailed description when taken in conjunction with the accompanying drawings.

BRIEF DESCRIPTION OF THE DRAWINGS

8

DETAILED DESCRIPTION OF PREFERRED EMBODIMENT

Figure 1:
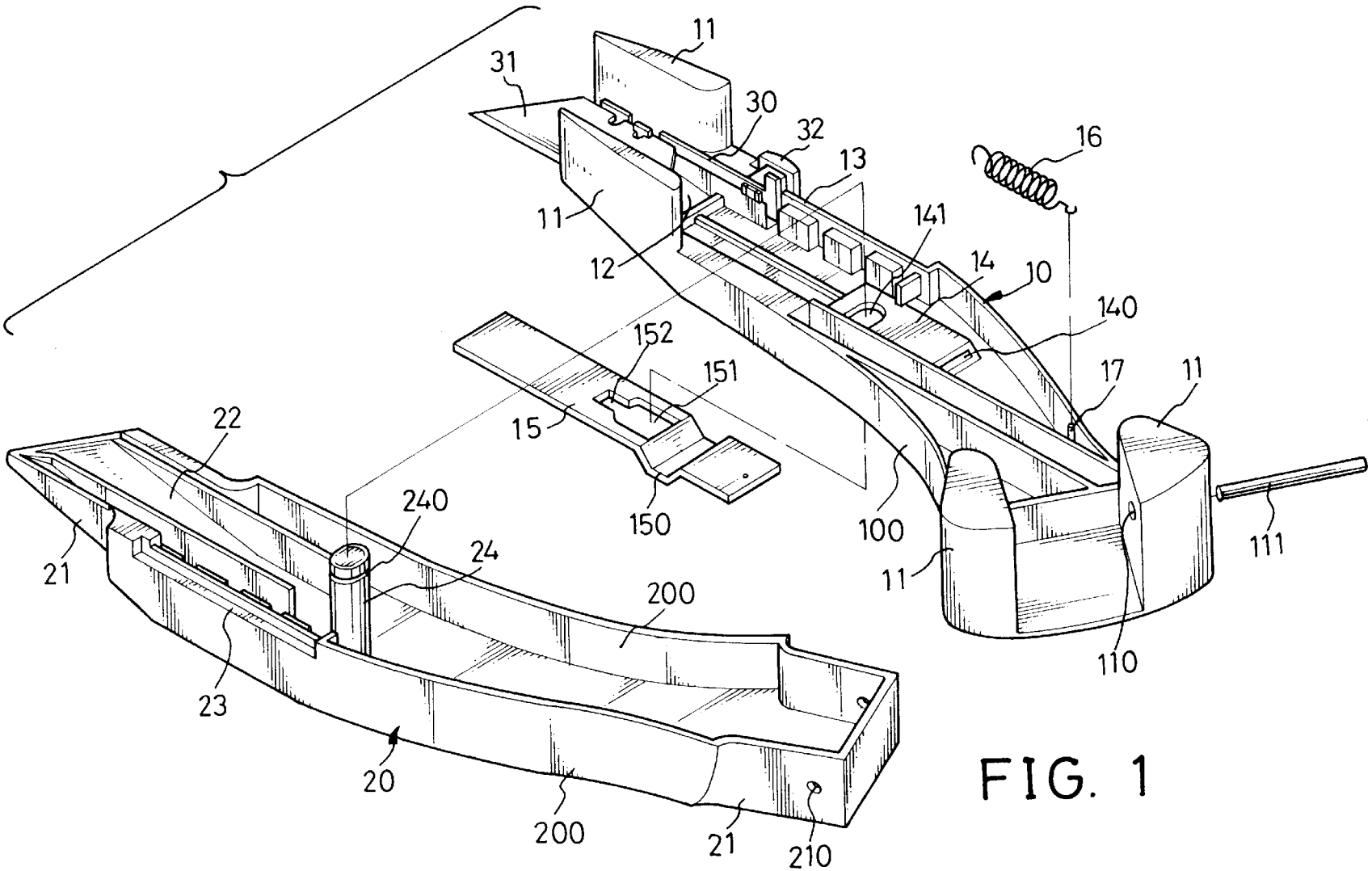
FIG. 1 is an exploded view showing a knife for woodworking in accordance with a first preferred embodiment of the present invention.

Referring to FIG. 1, a knife for woodworking in accordance with the present invention is comprised of a first casing 10 and a second casing 20, which have a basic structure similar to a conventional knife. The first casing 10 defines a front end (not numbered) and a rear end (not numbered) and has two opposed side walls 100. At each end there is a pair of opposed protrusions 11 respectively extending from the opposed side walls. The pair of protrusions 11 of the rear end define a pair of aligned holes therein. The second casing 20 defines a narrow front end (not numbered) and a narrow rear end (not numbered) and two opposed side walls 200 mating with the side walls 100 of the first casing 10. The narrow front end and the narrow rear end of the second casing 20 are exactly and respectively disposed between the two pairs of opposed protrusions 11 of the first casing 10. The side wall 200 at the narrow rear end of the second casing 20 defines thereon a pair of apertures 210 corresponding to the holes 110 of the first casing 10 so that a pin 111 can extend through the holes 110 and the apertures 210 to engage the first casing 10 with the second casing 20. The first casing 10 further defines a first channel 12 and a tool rest 30 on an inner surface thereof, and a first slot 13 on one of the two side walls 100. The second casing 20 defines a second channel 22 corresponding to the first channel 12 on an inner surface thereof and a second slot 23 on one of the two side walls 200 corresponding to the first slot 13. A double-ended blade 31 is mounted to the tool rest 30 and received within a space (not shown and not numbered) defined between the first and second channel 12, 22 in the combination of the first casing 10 and the second casing 20. A push button 32 is movably situated within the space (not shown and not numbered) defined by the between the first and second slot 13, 23 in the combination of the first casing 10 and the second casing 20 to control the movement of the blade 31.

In accordance with a first preferred embodiment of the present invention, the first casing 10 further defines a depression 14 extending inwardly from an outer surface at an appropriate position thereof. At the bottom of depression 14 an elliptical hole 141 and a slot 140 extend from a first side wall (not numbered) thereof to a second side wall opposed to the first side wall . An insert 15 passes through the slot 140 of the depression 14 and is located within the depression 14. The insert 15 is configured as a sheet with a length larger than a distance between the first side face and the second side face of the depression 14 and a width slightly smaller than that of the slot 140, thereby it can extend through the slot 140 (with a reference to FIG. 3). The insert 15 defines a corrugation 150 at an appropriate portion thereon for a user to shift the insert 15 with a finger. The insert 15 further defines thereon a wide slot 151 and a narrow slot 152 which is in front of the wide slot 151 and communicates with the wide slot 152. The width of the narrow slot 152 is less than that of the wide slot 151. A spring 16 is connected between a rear end of the insert 15 and a mount 17 disposed beside one of the side walls 100 of the first casing 10 to provide the insert with a restoring force. In an initial state, the insert 15 mounted within depression 14 will be pulled back by the spring 16 until corrugation 150 is retained by the first side wall of the depression 14.

The second casing 20 has a boss 24 integrally extending from an inner surface thereof to correspond to the wide and narrow slots 151, 152 of the insert 15. It is to be noted that the diameter of the boss 24 is continuously smaller than the width of the wide slot 151 and continuously larger than the width of the narrow slot 152. The boss 24 defines a circumferential recess 240 at an upper portion thereof. A diameter defined by the bottom of the circumferential recess 240 is slightly smaller than the width of the narrow slot 152.

Figure 2:
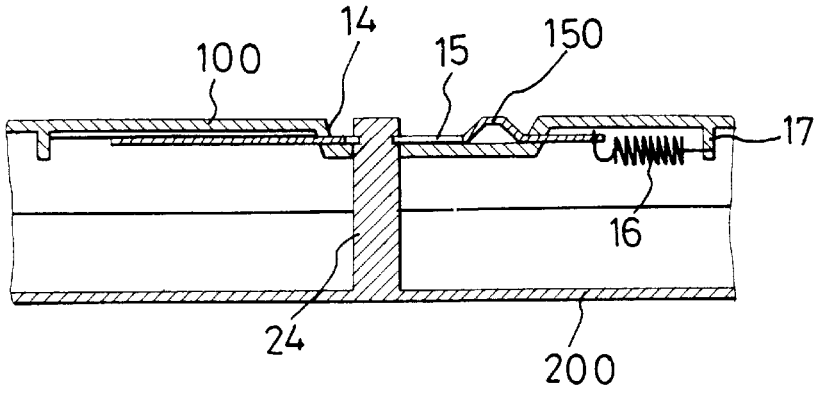
FIG. 2 is a partial cross sectional view showing the engagement of a first casing and a second casing of the knife for woodworking of FIG. 1.

In assembly, referring to FIG. 2, after the first casing 10 is pivotedly mounted with the second casing 20 at a rear end thereof and the insert 15 is engaged with the depression 14, the user may urge forward the corrugation 150 to make the wide slot 151 of the insert 15 align with the elliptical hole 141 of the depression 14.

Figure 3:
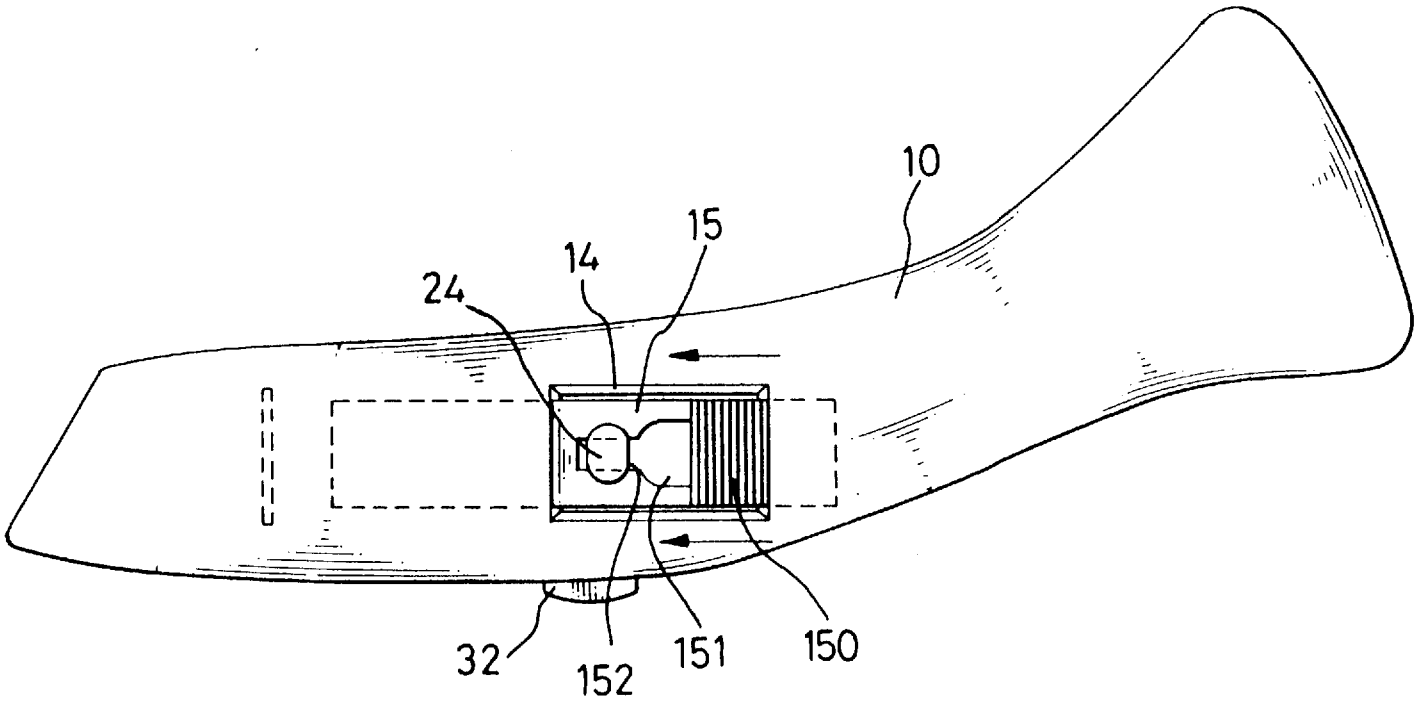
FIG. 3 is a first top view showing the disposition of an insert within a depression of the first casing of the knife for woodworking of FIG. 1.

The user can then close the first casing 10 and the second casing 20 so that the boss 24 of the second casing will pass through the elliptical hole 141 and the wide slot 151. Then the user may release the corrugation 150, and the insert 15 will restore to its initial state by means of the elastic force from the spring 16. At that time, the boss 24 will be aligned with the narrow slot 152 and the elliptical hole 141, and the circumferential recess 240 thereon will be interlocked with a periphery of the narrow slot 152, as shown in FIG. 2 and FIG. 3. In this way, the boss 24 can be positively interlocked with the insert 15 and the first casing 10 can be closely attached to the second casing 20.

Figure 5:
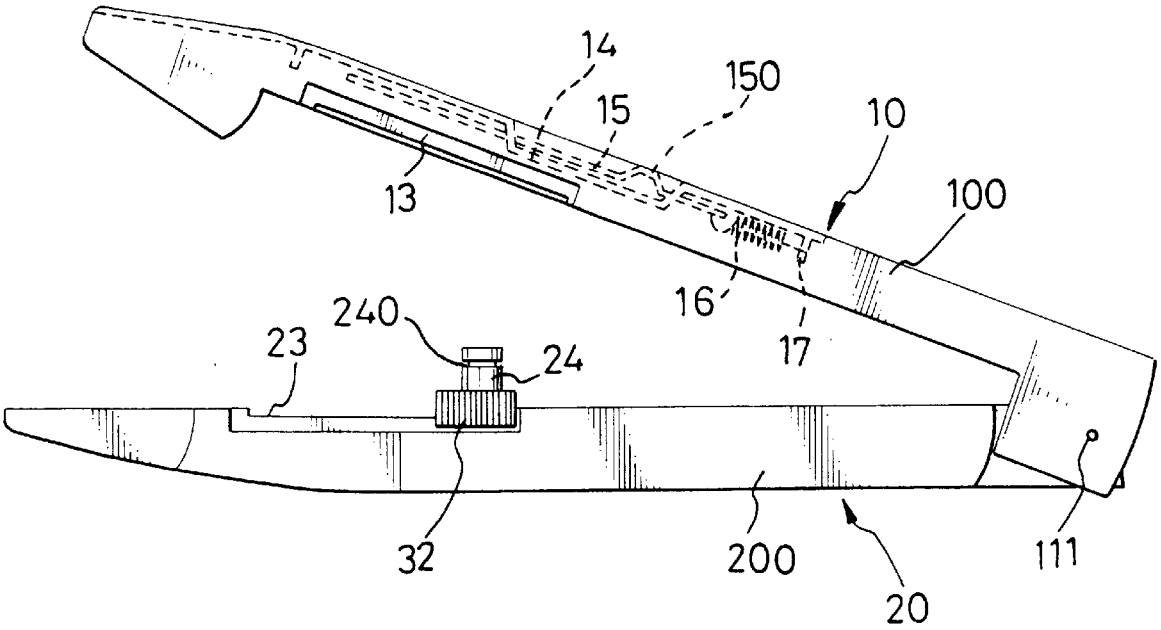
FIG. 5 is a schematic view of showing an open state of the knife for woodworking of FIG. 1.
Figure 4:
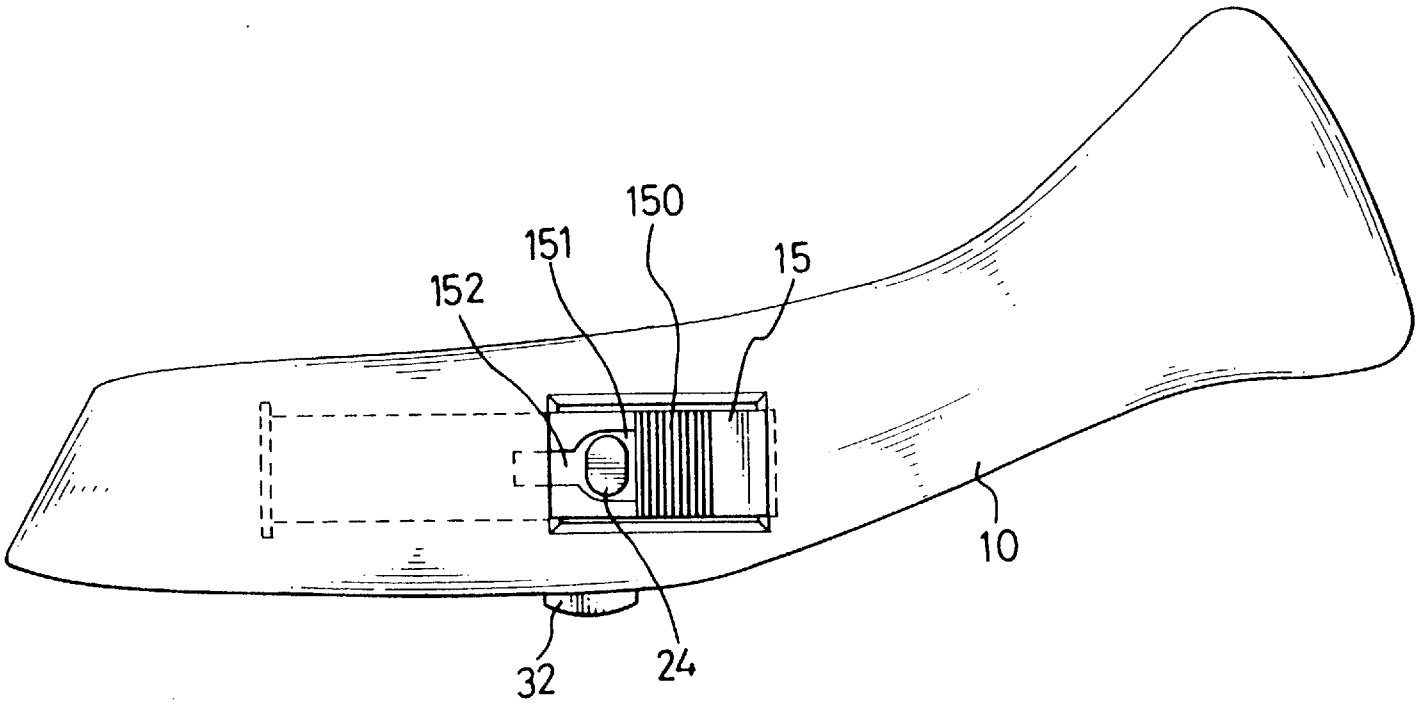
FIG. 4 is a second top view showing the operation of the insert within the depression of the first casing of the knife for woodworking of FIG. 1.

When the blade 31 is worn out and needs to be reversed to use or replaced, the user may urge the corrugation 150 of the insert 15 forward to make the narrow slot 152 shift out from the circumferential recess 240 of the boss 24, as shown in FIG. 3. Then the boss 24 will be aligned with the wide slot 151, as shown in FIG. 4. The width of the wide slot 151 is larger than the diameter of the boss 24 so that the boss may released from the insert 15 so as to open the first casing 10 and the second casing 20 (with a reference to FIG. 5), without disassembling the pin joint of the first casing 10 and the second casing 20. In this way, the blade 31 can be conveniently reverse or removed and disposed of.

Figure 6:
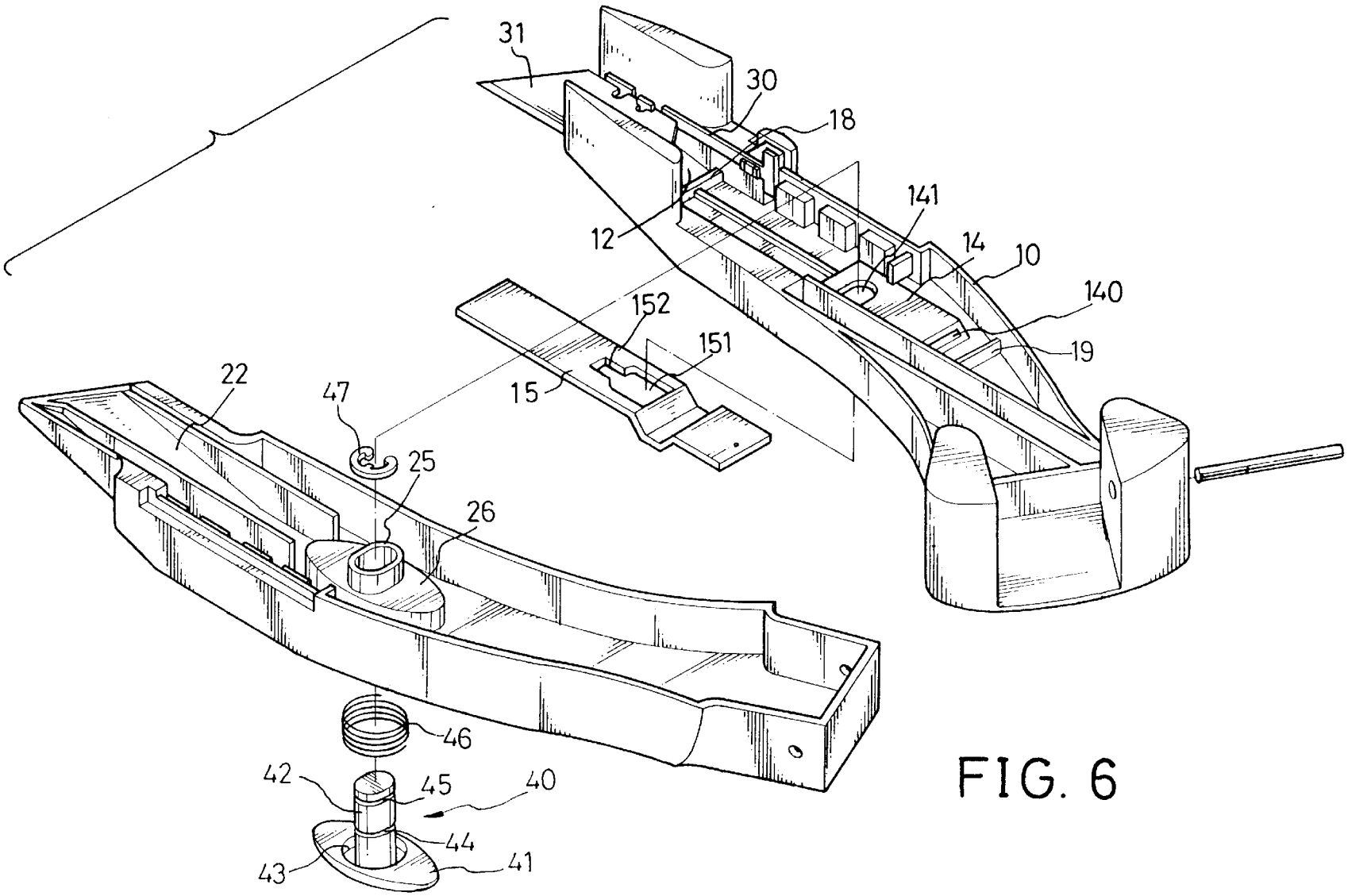
FIG. 6 is an exploded view showing a knife for woodworking in accordance with a second preferred embodiment of the present invention.

Referring to FIG. 6, in accordance with a second preferred embodiment of the present invention, the first casing 10 is configured the same as that in the first embodiment. The difference is that the second casing 20 defines a plate 26 extending inwardly from an appropriate portion of an outer surface thereof. A sleeve 25 extends from the bottom of the plate 26 to an inside of the second casing 20 and communicates with the plate 26. A fitting member 40 is fit into the plate 26 and the sleeve 25. The fitting member 40 is combined by a retainer 41 and a post 42. The retainer 41, which is configured to be received within the plate 26, defines a circular recess 43 therein. The post 42 extends from a bottom of the recess 43 into the sleeve 25. It is to be noted that the diameter of the post 42 is smaller than that of the circular recess 43, and a resilient means mounted around the post 42 can be compressed between inner walls of the circular recess 43 and the plate 26 to flexibly adjust the movement of the post 42. In this embodiment, a spring is used as the resilient means 46. Similar to the boss 24 in the first embodiment, the post 42 in the second embodiment corresponds to the elliptical hole 141 of the depression 14, and the diameter thereof is continuously smaller than the width of the wide slot 151, and larger than the width of the narrow slot 152 of the insert 15. The post 42 further defines a first circumferential recess 45 on a portion adjacent to a top portion thereof and a second circumferential recess 44 in an appropriate portion thereon. A diameter defined by the bottom of the first. circumferential recess 45 is slightly smaller than the width of the narrow slot 152 in the insert 15. A C-shaped ring 47 interlocks with the post 42 at the second circumferential recess 44 and its outer periphery retains an inner wall of the sleeve 25, which prevents the post 42 from being released from the sleeve 25.

Figure 7:
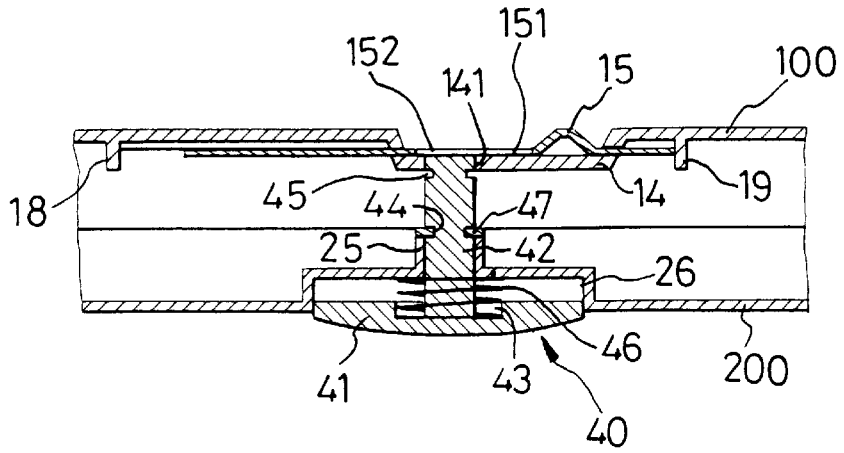
FIG. 7 is a partial cross sectional view showing a state interlocking before engagement of a first casing and a second casing of the knife for woodworking of FIG. 6.
Figure 8:
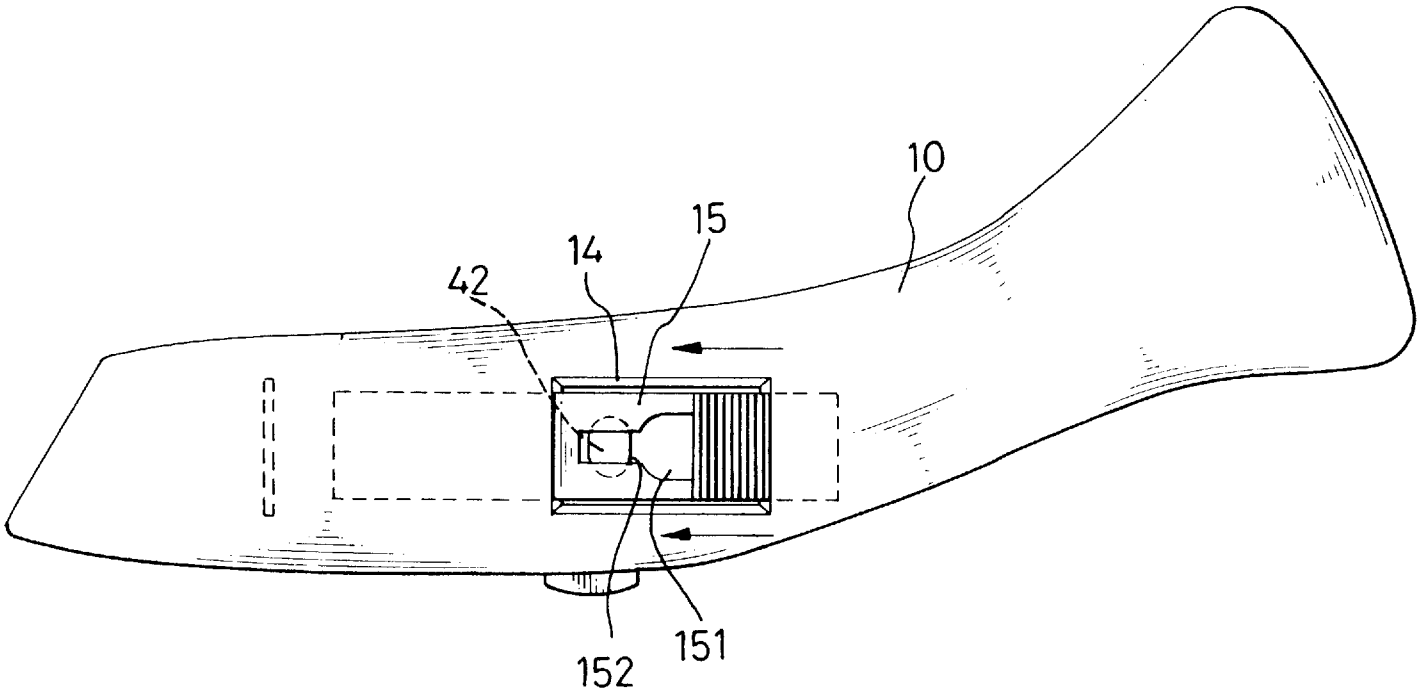
FIG. 8 is a first top view showing the disposition of an insert within a depression in the first casing of the knife for woodworking of FIG. 6.

Referring to FIG. 7, the fitting member 40 is designed so that, when the first casing 10 and the second casing 20 are closed, the distance between inner walls of the plate 26 and the retainer 41 is exactly equal to that between the first circumferential recess 45 and the insert 15. In this state, the top portion of the post 42 extends in the elliptical hole 141 of the depression 14, but has not reached the insert 15 within the depression 14 (with a reference to the top view of FIG. 8). From FIG. 7, it also can be seen that a first stopper 18 and a second stopper 19 are respectively integrally formed in the inner wall of the first casing 10 at an appropriate distance from two ends (not numbered) of the insert 15 to limit the movement of the insert 15.

Figure 10:
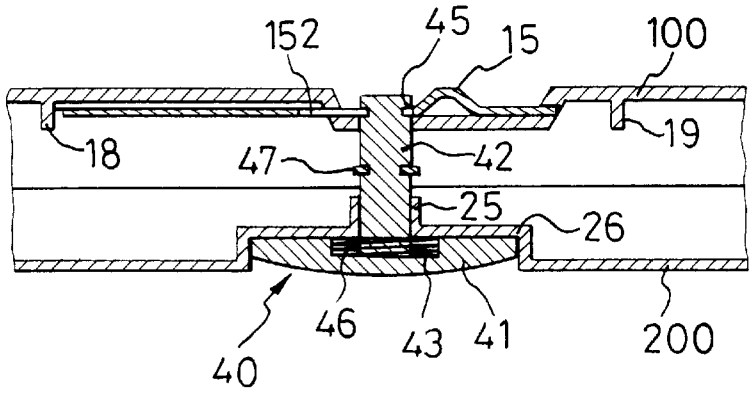
FIG. 10 and FIG. 11 are schematic views showing the interlocking engagement of the first casing and the second casing of the knife for woodworking of FIG. 6.
Figure 11:
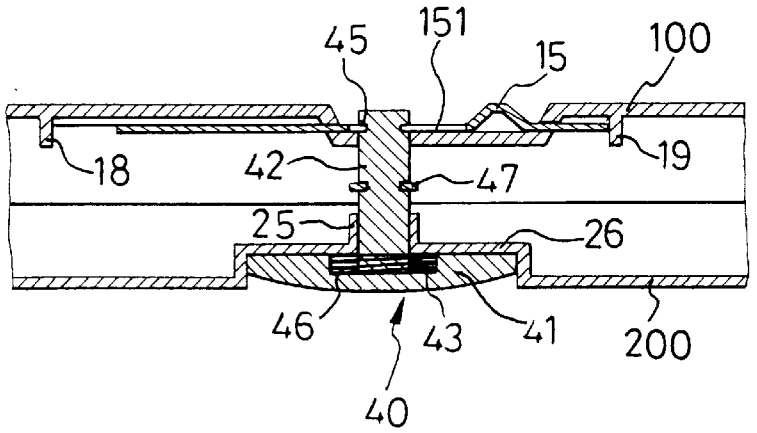
Figure 9:
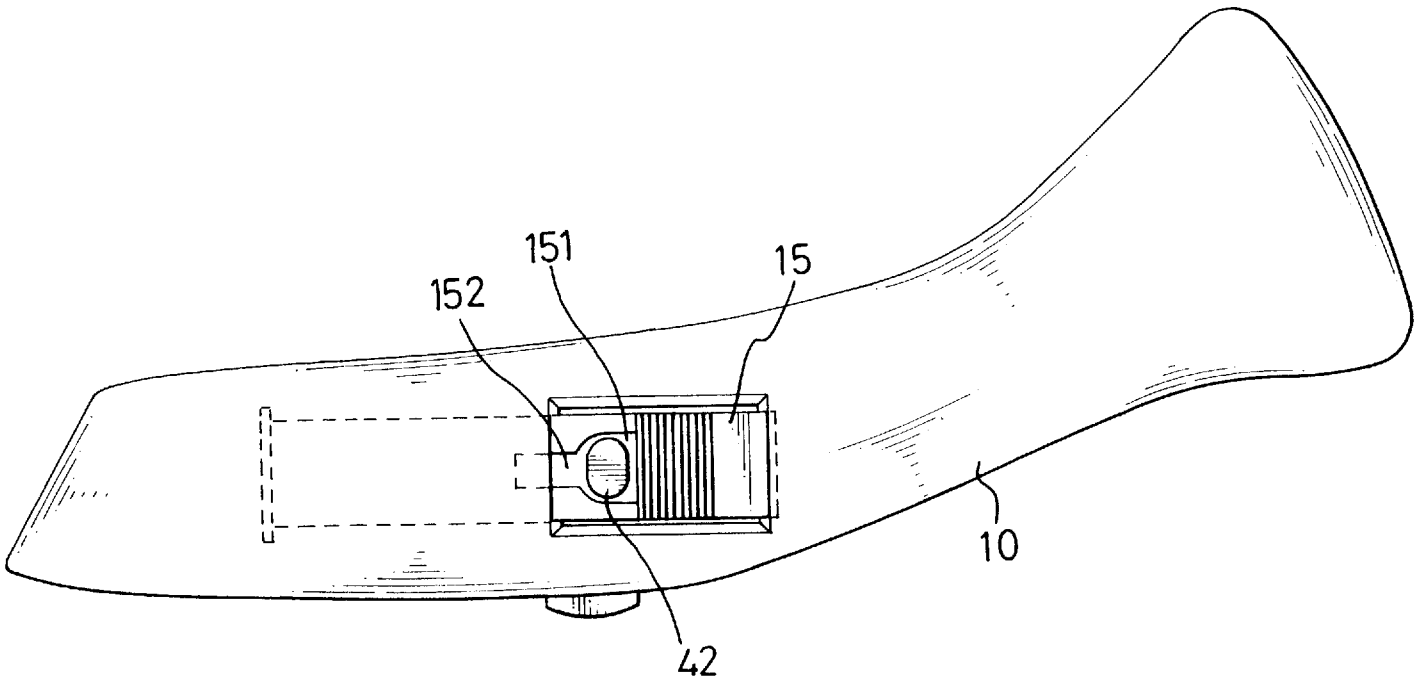
FIG. 9 is a second top view showing the operation of the insert within the depression in the first casing of the knife for woodworking of FIG. 6.
Figure 12:
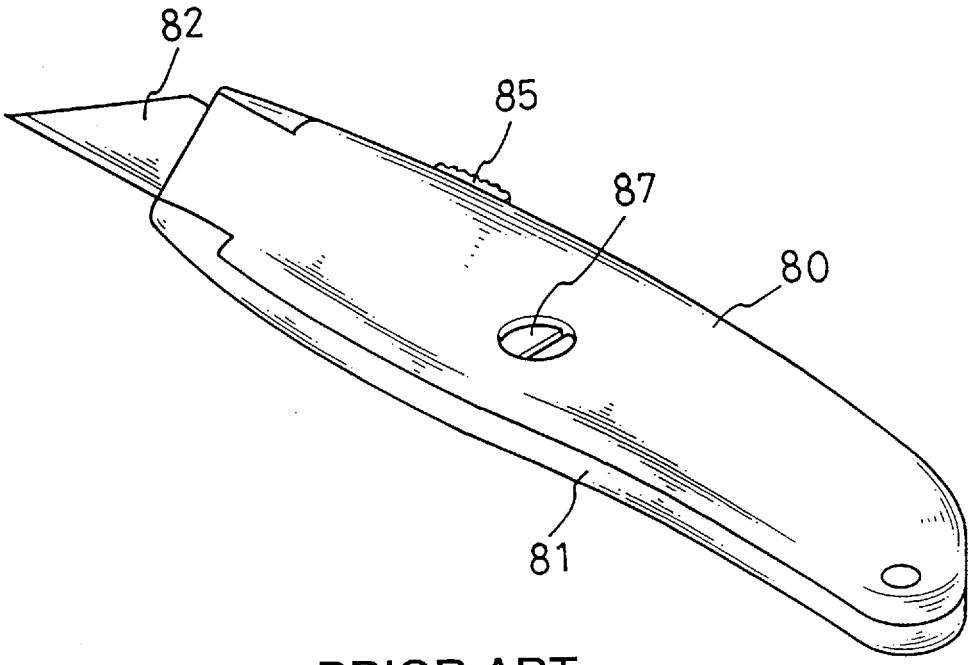
PRIOR ART FIG. 12
FIG. 12 is a perspective view showing a conventional knife for woodworking.
Figure 13:
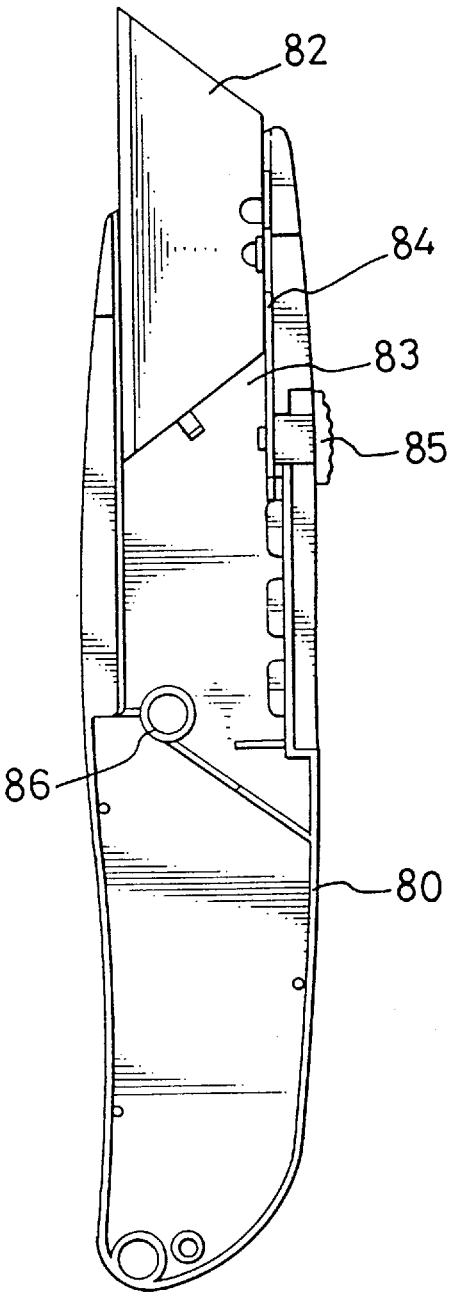
PRIOR ART FIG. 13
FIG. 13 is a cross-sectional view showing a conventional knife for woodworking.

The second embodiment in accordance with the present invention can obtain the same effect of convenient assembly and disassembly of the first and second casings 10, 20 to dispose the blade 31 as the first embodiment. When the blade 31 is to be reversed or replaced, the user may urge the insert 15 forward to make the wide slot 151 to align with the post 42 (see FIG. 9), and then push the fitting member 40 upwardly to make the post 42 extend through the wide slot 151 (see FIG. 10) and enable the first circumferential recess 45 to be at the same level as the narrow slot 152. The urging and pushing actions can be simultaneously accomplished by a thumb and a forefinger of the user. When the user releases the insert 15 to restore it to its initial state (see FIG. 11), an inside wall of narrow slot 152 will interlock with the first circumferential recess 45. In this way, the first casing 10 can be engaged with the second casing 20. Similar to the first embodiment, when the blade 31 is worn out and needs to be reversed or replaced, the steps of opening the first casing 10 and the second casing 20 in accordance with the second embodiment can be made by reversing the above mentioned steps of assembly of the casings 10, 20.

It is to be understood , however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A knife for woodworking comprising:

a first casing defining a depression extending inwardly from an outer surface thereof, and having an insert mounted within said depression, said insert defining thereon a wide slot and a narrow slot communicating with said wide slot;

a second casing joined with said first casing, said second casing having a fitting member extending from an outer surface of said second casing to engage said insert, said fitting member comprising a retainer and a post extending from said retainer, said post including a first circumferential recess adjacent a top portion thereof which aligns with said wide slot and said narrow slot of said insert of said first casing, and a resilient spring mounted around said post and compressed between said retainer and said outer surface of said second casing; and a blade disposed between said first casing and said second casing.

2. A knife for woodworking as claimed in claim 1, wherein said second casing further defines a plate extending inwardly from said outer surface thereof, said plate including a sleeve extending from a bottom of said plate to the inside of said second casing and communicating with said plate to receive said fitting member.

3. A knife for woodworking as claimed in claim 1, wherein said post further includes a second circumferential recess having a C-shaped ring interlocked with said second circumferential recess.

4. A knife for woodworking as claimed in claim 1, wherein said retainer further includes therein a circular recess with a diameter wider than that of said post so that said resilient spring is received and compressed therein.

* * * * *